US006203013B1

(12) United States Patent
Nitsche et al.

(10) Patent No.: US 6,203,013 B1
(45) Date of Patent: Mar. 20, 2001

(54) PUZZLE TOY

(75) Inventors: J. Gregory Nitsche, Silver Spring, MD (US); William J. Kelley, Arroyo Grande, CA (US); Lawrence Mass, Rye Brook, NY (US)

(73) Assignee: Mass Market Ideas LLC, Rye Brook, NY (US)

( * ) Notice: Subject to any disclaimer, the term of this patent is extended or adjusted under 35 U.S.C. 154(b) by 0 days.

(21) Appl. No.: 09/244,998

(22) Filed: Feb. 4, 1999

(51) Int. Cl.[7] ..... A63F 1/10; A63F 9/08

(52) U.S. Cl. ..... 273/153 R; 273/157 R; 273/148 A

(58) Field of Search ..... 273/153 R, 156, 273/157 R, 150, 148 A; 283/36, 39

(56) References Cited

U.S. PATENT DOCUMENTS

| | | | | |
|---|---|---|---|---|
| 59,603 | | 11/1866 | Hill . | |
| 179,023 | | 6/1876 | Hyatt et al. . | |
| D. 273,964 | | 5/1984 | Roth . | |
| D. 320,050 | | 9/1991 | Mannino . | |
| 411,577 | * | 9/1889 | Buland | 273/150 |
| 702,615 | | 6/1902 | Barden . | |

FOREIGN PATENT DOCUMENTS 652969 5/1951 (GB) .

(List continued on next page.)

*Primary Examiner*—Steven Wong
(74) *Attorney, Agent, or Firm*—Marshall, O'Toole, Gerstein, Murray & Borun

(57) ABSTRACT

A puzzle toy is composed of a plurality of relatively thin puzzle pieces having at least one image formed on their edges and a pair of holder members for holding the puzzle pieces. Each of the edges of the puzzle pieces has a different portion of an image disposed thereon so that when the edges of the puzzle pieces are arranged in a predetermined order the image is formed thereon. The puzzle toy also includes a puzzle piece holder having a first holder member in which the puzzle pieces may be at least partially disposed and a second holder member. One of the holder members has an opening formed therein, and the holder members are configurable in a storage position in which the puzzle pieces are retained within the holder members while allowing the image to be viewed through the opening and in which the puzzle pieces are retained within the holder members regardless of the orientation of the puzzle piece holder. The holder members are also configurable in a puzzle-solving position in which the second holder member is disposed in a horizontal position and in which the first holder member is disposed at an angled position.

20 Claims, 2 Drawing Sheets

U.S. PATENT DOCUMENTS

| | | | | |
|---|---|---|---|---|
| 959,754 | | 5/1910 | Kennedy . | |
| 1,028,130 | | 6/1912 | Newell . | |
| 1,229,580 | | 6/1917 | Brown . | |
| 1,359,115 | | 11/1920 | Sittinger . | |
| 1,636,371 | | 7/1927 | Kenney . | |
| 1,681,759 | | 8/1928 | Appley . | |
| 1,702,505 | * | 2/1929 | Groves | 273/157 R |
| 2,483,833 | | 10/1949 | Levin . | |
| 2,491,296 | | 12/1949 | Beder | 273/157 R |
| 2,493,697 | | 1/1950 | Raczkowski . | |
| 2,581,492 | | 1/1952 | Lowe et al. . | |
| 2,610,856 | | 9/1952 | Welty | 273/160 |
| 2,731,766 | | 1/1956 | Rubin . | |
| 2,749,129 | | 6/1956 | Vose | 273/157 R |
| 2,946,137 | | 7/1960 | Worth et al. . | |
| 2,953,380 | | 9/1960 | Hassenbach | 273/157 R |
| 3,010,723 | | 11/1961 | Moss | 273/157 R |
| 3,159,404 | * | 12/1964 | Midgley et al. | 273/150 |
| 3,540,732 | | 11/1970 | Wilson | 273/157 R |
| 3,707,287 | | 12/1972 | Spector | 273/157 R |
| 3,779,558 | | 12/1973 | Moreau | 273/157 R |
| 3,817,492 | * | 6/1974 | Raymer | 283/36 |
| 3,854,726 | | 12/1974 | Balder | 273/157 R |
| 4,021,939 | * | 5/1977 | May | 273/157 R |
| 4,040,630 | | 8/1977 | Brattain | 273/157 R |
| 4,050,698 | | 9/1977 | Brown . | |
| 4,427,290 | * | 1/1984 | Kaye et al. | 283/36 |
| 4,469,331 | | 9/1984 | Rinker | 273/157 R |
| 4,570,936 | | 2/1986 | Meiser et al. | 273/157 R |
| 4,573,684 | | 3/1986 | Riley et al. | 273/157 R |
| 4,625,969 | | 12/1986 | Donnell | 273/157 R |
| 4,640,512 | | 2/1987 | Burke | 273/157 R |
| 4,669,734 | | 6/1987 | Watkins | 273/157 R |
| 4,684,132 | * | 8/1987 | Wolford | 273/150 |
| 4,792,138 | | 12/1988 | Watkins | 273/157 R |
| 4,865,324 | | 9/1989 | Nesis | 273/155 |
| 4,874,176 | | 10/1989 | Auerbach | 273/157 R |
| 5,022,655 | | 6/1991 | Meyer | 273/157 R |
| 5,062,637 | | 11/1991 | Bianchi | 273/157 R |
| 5,067,714 | | 11/1991 | Raspberry | 273/157 R |
| 5,098,102 | | 3/1992 | Cooper | 273/157 R |
| 5,149,570 | | 9/1992 | Cain | 428/33 |
| 5,160,296 | * | 11/1992 | Katz | 283/36 |
| 5,178,391 | | 1/1993 | Schoen | 273/153 R |
| 5,219,168 | | 6/1993 | Morris | 273/157 R |
| 5,257,785 | | 11/1993 | Sugie | 273/157 R |
| 5,417,457 | * | 5/1995 | Reinhardt | 283/36 |
| 5,544,882 | | 8/1996 | Sarkar | 273/157 R |
| 5,628,513 | | 5/1997 | Soriano | 273/157 R |
| 5,681,041 | | 10/1997 | Coon | 273/157 R |
| 5,683,086 | | 11/1997 | Druckman et al. | 273/156 |
| 5,700,177 | | 12/1997 | Lemelson | 446/117 |
| 5,853,259 | * | 12/1998 | Murray, Jr. | 283/36 |

* cited by examiner

PUZZLE TOY

BACKGROUND OF THE INVENTION

The present invention relates to a puzzle toy having a plurality of relatively thin puzzle pieces having an image formed on their edges and a puzzle piece holder.

U.S. Pat. No. 3,854,726 to Balder discloses a screen photograph puzzle having a number of relatively thin puzzle pieces with edges on which an image is disposed. Each of the puzzle pieces is rectangular in shape. The puzzle pieces are formed by transferring an image, such as a photograph, to a rigid backing, composed of wood or plastic for example, and then cutting the rigid backing with the image formed thereon into a plurality of separate pieces.

U.S. Pat. No. 2,491,296 to Beder discloses a puzzle having a plurality of puzzle sticks which may be disposed within a container having a first box portion 22 and a second box portion 24. Each of the puzzle sticks has a side portion on which an image is formed, and when the puzzle sticks are positioned adjacent each other in a predetermined sequence, an entire image is formed. As shown in FIG. 5 of the Beder patent, the puzzle sticks may be disposed in a display position in which the puzzle sticks are positioned within the box portion 22 and in which the box portion 22 is held upright by the box portion 24, with the box portion 22 being disposed in a slot 27 formed in the box portion 22.

SUMMARY OF THE INVENTION

The present invention is directed to a puzzle toy composed of a plurality of relatively thin puzzle pieces having at least one image formed on their edges and a pair of holder members for holding the puzzle pieces.

In one aspect of the invention, the thickness of the puzzle pieces is no greater than about one-fifth of an inch and the ratio of the width of the puzzle pieces to the thickness of the puzzle pieces is at least about 2:1. Each of the puzzle pieces has an edge with a height no greater than about one-third of an inch. Each of the edges of the puzzle pieces has a different portion of an image disposed thereon so that when the edges are arranged in a predetermined order the image is formed thereon.

The puzzle toy also includes a puzzle piece holder having a first holder member and a second holder member. One of the holder members has an opening formed therein, and the holder members are configurable in a storage position in which the puzzle pieces are retained within the holder members while allowing the image to be viewed through the opening and in which the puzzle pieces are retained within the holder members regardless of the orientation of the puzzle piece holder.

The holder members are also configurable in a puzzle-solving position in which the first holder member is disposed at an acute angle relative to the second holder member and in which the second holder member is disposed in a horizontal position and in which the first holder member is disposed at an angled position. The first holder member is adapted to hold the puzzle pieces so that the lengths of the puzzle pieces are generally parallel to the angled position of the first holder member and so that substantially all portions of the edges of the puzzle pieces are exposed so that one of the puzzle pieces may be removed from the first holder member by tilting the one puzzle piece away from the first holder member.

The first holder member may have a pair of slots formed therein, and the second holder member may have a pair of projecting members which are disposed on the second holder member so that the projecting members may be disposed within the slots of the first holder member to hold the first holder member in the puzzle-solving position. Alternatively, the projecting members may be spaced so that the projecting members can be disposed within the slots when the holder members are disposed in the storage configuration to fasten the first and second holder members together.

In another aspect of the invention, each of the puzzle pieces may have a first edge and a second edge, each of the first edges having a different portion of a first image disposed thereon so that when the first edges of the puzzle pieces are arranged in a predetermined order the first image is formed thereon, and each of the second edges having a different portion of a second image disposed thereon so that when the second edges of the puzzle pieces are arranged in a predetermined order the second image is formed thereon. Each of the holder members is provided with an opening so that when the holder members are configured in a storage position in which the puzzle pieces are retained within the holder members the first image can be viewed through the opening in the first holder member and the second image can be viewed through the opening in the second holder member.

The portions of the images may be disposed on the edges of the puzzle pieces so that the first image is formed when the puzzle pieces are arranged in a first predetermined order and so that the second image is formed when the puzzle pieces are arranged in a second predetermined order, the second predetermined order being different than the first predetermined order.

In a third aspect of the invention, each of the puzzle pieces has a central portion and a tab which extends from the central portion so as to facilitate repositioning of one of the puzzle pieces relative to another of the puzzle pieces.

The features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
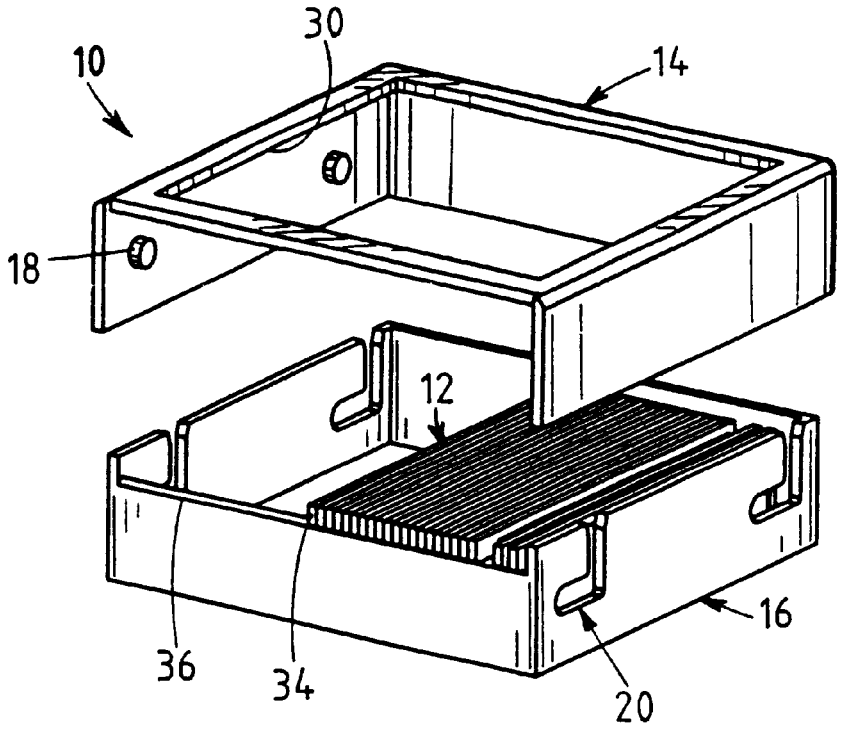
FIG. 1 is a perspective view of a preferred embodiment of a puzzle toy in accordance with the invention.

A preferred embodiment of a puzzle toy 10 in accordance with the invention is shown in FIG. 1. Referring to FIG. 1, the puzzle toy 10 includes a plurality of relatively thin puzzle pieces 12 which may be disposed within a container or holder composed of an upper puzzle piece holder member 14 and a lower puzzle piece holder member 16. The puzzle pieces 12 and the holder members 14, 16 may be plastic, in which case they may be formed by injection molding.

The upper holder member 14 has four cylindrically shaped members 18 that project outwardly from a pair of parallel interior side walls of the upper holder member 14. Each of the projecting members 18 is located on the upper holder member 14 so that it may be received or positioned within a respective one of four L-shaped slots 20 formed in a pair of parallel walls of the lower holder member 16.

The holder members 14, 16 may be configured in a storage position in which the upper holder member 14 covers the lower holder member 16, with the puzzle pieces 12 between the two holder members 14, 16, so that the puzzle pieces are retained within the two holder members 14, 16 regardless of the orientation of the puzzle toy 10. This configuration is accomplished by positioning the upper holder member 14 over the lower holder member 16 so that the projecting members 18 are aligned with the slots 20, moving the upper holder member 14 downwardly so that each of the projecting members 18 is received into a vertical portion of respective one of the L-shaped slots 20, and sliding the upper holder member 14 horizontally relative to the lower holder member 16 so that each of the projecting members 18 abuts an end portion of a respective one of the slots 20.

Figure 2:
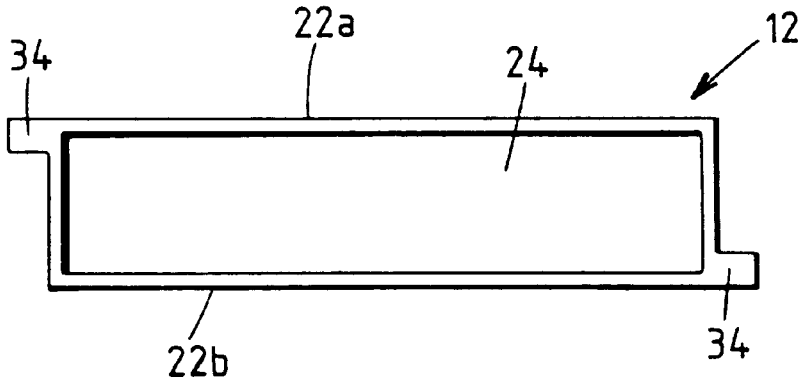
FIG. 2 is a side view of an embodiment of one of the puzzle pieces of the puzzle toy.
Figure 3:
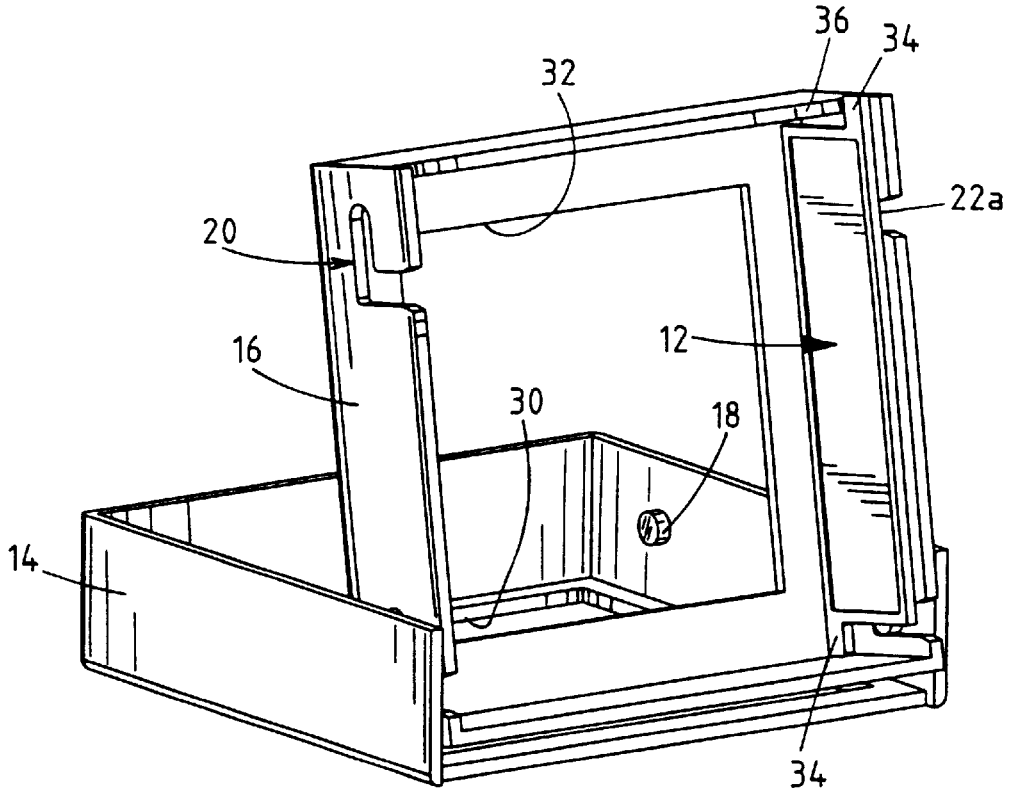
FIG. 3 is a perspective view of a pair of puzzle piece holder members disposed in a puzzle-solving position.

Referring to FIGS. 2 and 3, each of the puzzle pieces 12 is relatively thin and has a generally rectangular shape. Each of the puzzle pieces 12 has a pair of elongate edges 22*a*, 22*b* parallel to the length of the puzzle pieces 12, with the edges 22*a*, 22*b* being disposed between two rectangular, parallel surfaces 24 of the puzzle pieces 12. The length of the puzzle pieces 12 may be about four inches, the height of the puzzle pieces 12 may be about one inch, and the thickness of the puzzle pieces 12, and the corresponding height of the edges 22*a*, 22*b*, may be approximately 0.08 of an inch. Preferably, the thickness of the puzzle pieces 12 is no greater than about one-third of an inch, or alternatively no greater than about one-fifth or one-eighth of an inch, and the ratio of the height of the puzzle pieces 12 to the thickness of the puzzle pieces 12 is at least about 2:1, or alternatively at least about 4:1 or 8:1.

One of the edges 22*a* of each of the puzzle pieces 12 has a different portion of an image formed thereon. The image portions may be formed on the edges 22*a* in any conventional manner, such as by printing. For example, the image portions could be formed by a heat-transfer process by positioning a film having a complete printed image formed thereon over one of the surfaces formed by the edges 22*a*, 22*b* when all of the puzzle pieces 12 are disposed tightly adjacent each other, and then applying heat to cause the image on the film to be transferred to the surface formed by the edges 22*a*, 22*b*.

Figure 4A:
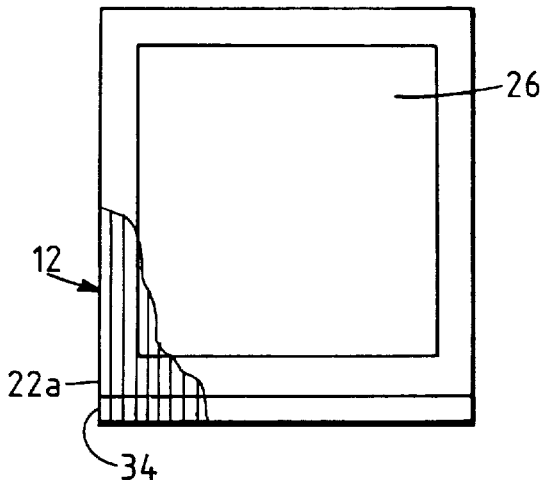
FIG. 4A is a view of a first side of each of the puzzle pieces on which a first image is formed.
Figure 4B:
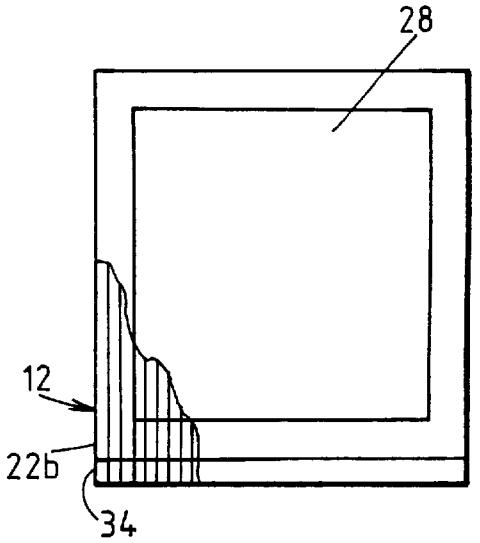
FIG. 4B is a view of a second side of each of the puzzle pieces on which a second image is formed.

Referring to FIG. 4A, when the puzzle pieces 12 are positioned adjacent each other in a predetermined order, the image portions on their edges 22*a* form a complete image, which is schematically shown as a rectangle designated 26 in FIG. 4A (for purposes of simplicity, not all of the puzzle pieces 12 are individually shown in FIGS. 4A and 4B).

Alternatively, each of the two elongate edges 22*a*, 22*b* of each puzzle piece 12 may be provided with a different portion of one of two images so that two complete images are formed when the puzzle pieces 12 are positioned with their edges 22*a*, 22*b* adjacent. FIG. 4B illustrates the puzzle pieces 12 disposed in a predetermined order so that the image portions disposed on their edges 22*b* form a second complete image, schematically shown in FIG. 4B as a rectangle designated 28, the second image 28 being different than the first image 26.

Where two images 26, 28 are provided on the puzzle toy 10, both of the images may be formed by the user of the puzzle toy 10 by arranging the puzzle pieces 12 in a single predetermined order. Alternatively, one of the images 26, 28 may be formed by the user by arranging the puzzle pieces 12 in a first predetermined order, and the other image may be formed by the user by arranging the puzzle pieces 12 in a second predetermined order, different than the first predetermined order.

In the latter case, the image portions on the puzzle pieces 12 could be applied, during manufacture, by placing the puzzle pieces 12 in the first predetermined order, affixing one of the images 26, 28 to the surface formed by the edges 22*a*, "shuffling" the puzzle pieces 12 to place them in a second order different than the first order, and then affixing the other of the images 26, 28 to the surface formed by the edges 22*b*.

As shown in FIGS. 1 and 3, an opening 30 may be formed in the upper holder member 14 and an opening 32 may be formed in the lower holder member 16. The openings 30, 32 may be provided so that each of the images 26, 28 is visible through one of the openings 30, 32 when the holder members 14, 16 are configured in their storage position described above in connection with FIG. 1.

As shown in FIG. 2, each of the puzzle pieces 12 may be provided with a pair of diametrically opposed tabs 34 to make the manipulation of the puzzle pieces 12 easier. As shown in FIGS. 1 and 3, the tabs 34 extend over a lowered side edge 36 of the lower holder member 16.

As shown in FIG. 3, the holder members 14, 16 are configurable in a puzzle-solving position in which two of the projecting members 18 of the holder member 14 are disposed in two of the slots 20 in the holder member 16 so that the holder member 16 is supported at an acute angle relative to the holder member 14 and in an angled position approaching vertical. The tilted-back position of the holder member 16 helps to retain the puzzle pieces 12 in the holder member 16 by means of gravity. Further backward rotation or pivoting of the holder member 16 relative to the holder member 14 is prevented by the contact of a lower corner edge of the holder member 16 with the interior surface of the holder member 14.

When the puzzle pieces 12 are stood on end within the holder member 16 in the puzzle-solving configuration shown in FIG. 3 so that the lengths of the puzzle pieces 12 are generally parallel to the angled position of the holder member 16 and so that substantially all portions of the edges 22*a* of the puzzle pieces 12 are exposed, a puzzle piece 12 can easily be moved to a different location, or re-ordered, relative to the other puzzle pieces 12 by tilting the puzzle piece 12 to be moved forward, or away from the holder member 16, via its upper tab 34, moving the puzzle piece 12 to the desired location, and releasing the puzzle piece 12 so that it falls back against the interior of the holder member 16. As the puzzle pieces 12 are re-ordered from a random order to a predetermined order, one of the images 26, 28 will gradually come into view or focus.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A puzzle toy comprising:

a plurality of puzzle pieces, each of said puzzle pieces having a length, a width, and a thickness, said thickness of said puzzle pieces being no greater than about one-third of an inch and the ratio of said width of said puzzle pieces to said thickness of said puzzle pieces being at least about 2:1, each of said puzzle pieces having a first surface and a second surface and an edge disposed between said first and second surfaces, each of said edges of said puzzle pieces having a height no greater than about one-third of an inch, each of said edges of said puzzle pieces having a different portion of an image disposed thereon so that when said edges of said puzzle pieces are arranged in a predetermined order said image is formed thereon; and a puzzle piece holder for holding said puzzle pieces, said puzzle piece holder comprising:

a first holder member in which said puzzle pieces may be at least partially disposed; and a second holder member associated with said first holder member, one of said first and second holder members having an opening formed therein, said first and second holder members being configurable in a storage position in which said puzzle pieces are retained within said first and second holder members while allowing said image to be viewed through said opening, said puzzle pieces being retained within said first and second holder members regardless of the orientation of said puzzle piece holder when said first and second holder members are configured in said storage position, and said first and second holder members being configurable in a puzzle-solving position in which said first holder member is disposed at an acute angle relative to said second holder member and in which said second holder member is disposed in a horizontal position and in which said first holder member is disposed at an angled position, said first holder member being adapted to hold said puzzle pieces so that said lengths of said puzzle pieces are generally parallel to said angled position of said first holder member and so that substantially all portions of said edges of said puzzle pieces are exposed so that one of said puzzle pieces may be removed from said first holder member by tilting said one puzzle piece away from said first holder member.

2. A puzzle toy as defined in claim 1 wherein said first holder member has a pair of slots formed therein and wherein said second holder member has a pair of projecting members which are disposed on said second holder member so that said projecting members may be disposed within said slots of said first holder member to hold said first holder member in said puzzle-solving position.

3. A puzzle toy as defined in claim 1 wherein said first holder member has a pair of slots formed therein and wherein said second holder member has a pair of projecting members which are disposed on said second holder member so that said projecting members may be disposed within said slots of said first holder member to hold said first holder member in said puzzle-solving position, said first holder member being held at said angled position by an edge of one of said holder members contacting a portion of the other holder member.

4. A puzzle toy as defined in claim 1 wherein each of said puzzle pieces has a second edge disposed between said first and second surfaces, each of said second edges of said puzzle pieces having a height no greater than about one-third of an inch, each of said second edges of said puzzle pieces having a different portion of a second image disposed thereon so that when said second edges of said puzzle pieces are arranged in a predetermined order said second image is formed thereon.

5. A puzzle toy as defined in claim 4 wherein said first holder member of said puzzle piece holder has a first opening formed therein and wherein said second holder member of said puzzle piece holder has a second opening formed therein, and wherein each of said images disposed on said edges of said puzzle pieces is visible through one of said openings in said first and second holder members of said puzzle piece holder.

6. A puzzle toy as defined in claim 1 wherein each of said puzzle pieces has a rectangular portion and a tab which extends from said rectangular portion so as to facilitate repositioning of one of said puzzle pieces relative to another of said puzzle pieces.

7. A puzzle toy as defined in claim 6 wherein one of said holder members of said puzzle piece holder has a plurality of side walls and wherein one of said side walls has a top portion over which said tabs of said puzzle pieces are disposed when said puzzle pieces are disposed between said side walls.

8. A puzzle toy as defined in claim 1 wherein one of said holder members has a plurality of slots formed therein and wherein the other of said holder members has a plurality of projecting members spaced so that said projecting members can be disposed within said slots when said first and second holder members are disposed in said storage configuration to fasten said first and second holder members together.

9. A puzzle toy comprising:

a plurality of puzzle pieces, each of said puzzle pieces having a length, a width, and a thickness, said thickness of said puzzle pieces being no greater than about one-third of an inch, each of said puzzle pieces having a first surface and a second surface and a first edge disposed between said first and second surfaces, each of said first edges of said puzzle pieces having a height no greater than about one-third of an inch, each of said first edges of said puzzle pieces having a different portion of a first image disposed thereon so that when said first edges of said puzzle pieces are arranged in a predetermined order said first image is formed thereon, each of said puzzle pieces having a second edge disposed between said first surface and said second surface, each of said second edges of said puzzle pieces having a height no greater than about one-third of an inch, each of said second edges of said puzzle pieces having a different portion of a second image disposed thereon so that when said second edges of said puzzle pieces are arranged in a predetermined order said second image is formed thereon; and a puzzle piece holder for holding said puzzle pieces, said puzzle piece holder comprising:

a first holder member in which said puzzle pieces may be at least partially disposed, said first holder member having an opening formed therein; and a second holder member associated with said first holder member, said second holder member having an opening formed therein, said first and second holder members being configurable in a storage position in which said puzzle pieces are retained within said first and second holder members while allowing said first image to be viewed through said opening in said first holder member and said second image to be viewed through said opening in said second holder member, said puzzle pieces being retained within said first and second holder members regardless of the orientation of said puzzle piece holder when said first and second holder members are configured in said storage position.

10. A puzzle toy as defined in claim 9 wherein said portions of said images are disposed on said edges of said puzzle pieces so that said first image is formed when said puzzle pieces are arranged in a first predetermined order and so that said second image is formed when said puzzle pieces are arranged in a second predetermined order, said second predetermined order being different than said first predetermined order.

11. A puzzle toy as defined in claim 9 wherein each of said puzzle pieces has a rectangular portion and a tab which extends from said rectangular portion so as to facilitate repositioning of one of said puzzle pieces relative to another of said puzzle pieces.

12. A puzzle toy as defined in claim 11 wherein one of said holder members of said puzzle piece holder has a plurality of side walls and wherein one of said side walls has a top portion over which said tabs of said puzzle pieces are disposed when said puzzle pieces are disposed between said side walls.

13. A puzzle toy as defined in claim 9 wherein one of said holder members has a plurality of slots formed therein and wherein the other of said holder members has a plurality of projecting members spaced so that said projecting members can be disposed within said slots when said first and second holder members are disposed in said storage configuration to fasten said first and second holder members together.

14. A puzzle toy comprising:

a plurality of puzzle pieces, each of said puzzle pieces having a length, a width, and a thickness, each of said puzzle pieces having a first surface and a second surface and an edge disposed between said first and second surfaces, each of said edges of said puzzle pieces having a different portion of an image disposed thereon so that when said edges of said puzzle pieces are arranged in a predetermined order said image is formed thereon, each of said puzzle pieces having a central portion and a tab which extends from said central portion so as to facilitate repositioning of one of said puzzle pieces relative to another of said puzzle pieces; and a puzzle piece holder for holding said puzzle pieces, said puzzle piece holder comprising:

a first holder member in which said puzzle pieces may be at least partially disposed; and a second holder member associated with said first holder member, said first and second holder members being configurable in a storage position in which said puzzle pieces are retained within said first and second holder members regardless of the orientation of said puzzle piece holder.

15. A puzzle toy comprising:

a plurality of puzzle pieces, each of said puzzle pieces having a length, a width, and a thickness, each of said puzzle pieces having a first surface and a second surface and an edge disposed between said first and second surfaces, each of said edges of said puzzle pieces having a different portion of an image disposed thereon so that when said edges of said puzzle pieces are arranged in a predetermined order said image is formed thereon, each of said puzzle pieces having a central portion and a tab which extends from said central portion so as to facilitate repositioning of one of said puzzle pieces relative to another of said puzzle pieces; and a puzzle piece holder for holding said puzzle pieces, said puzzle piece holder comprising:

a first holder member in which said puzzle pieces may be at least partially disposed; and a second holder member associated with said first holder member, said first and second holder members being configurable in a storage position in which said puzzle pieces are retained within said first and second holder members regardless of the orientation of said puzzle piece holder, wherein said first holder member has a pair of slots formed therein and wherein said second holder member has a pair of projecting members which are disposed on said second holder member so that said projecting members may be disposed within said slots of said first holder member to hold said first holder member in a puzzle-solving position relative to said second holder member.

16. A puzzle toy comprising:

a plurality of puzzle pieces, each of said puzzle pieces having a length, a width, and a thickness, each of said puzzle pieces having a first surface and a second surface and an edge disposed between said first and second surfaces, each of said edges of said puzzle pieces having a different portion of an image disposed thereon so that when said edges of said puzzle pieces are arranged in a predetermined order said image is formed thereon, each of said puzzle pieces having a central portion and a tab which extends from said central portion so as to facilitate repositioning of one of said puzzle pieces relative to another of said puzzle pieces; and a puzzle piece holder for holding said puzzle pieces, said puzzle piece holder comprising:

a first holder member in which said puzzle pieces may be at least partially disposed; and a second holder member associated with said first holder member, said first and second holder members being configurable in a storage position in which said puzzle pieces are retained within said first and second holder members regardless of the orientation of said puzzle piece holder, wherein said first holder member has a pair of slots formed therein and wherein said second holder member has a pair of projecting members which are disposed on said second holder member so that said projecting members may be disposed within said slots of said first holder member to hold said first holder member in a puzzle-solving position in which said first holder member is disposed at an acute angle relative to said second holder member, said first and second holder members being held at said acute angle by an edge of one of said holder members contacting a portion of the other holder member.

17. A puzzle toy comprising:

a plurality of puzzle pieces, each of said puzzle pieces having a length, a width, and a thickness, each of said puzzle pieces having a first surface and a second surface and an edge disposed between said first and second surfaces, each of said edges of said puzzle pieces having a different portion of an image disposed thereon so that when said edges of said puzzle pieces are arranged in a predetermined order said image is formed thereon, each of said puzzle pieces having a central portion and a tab which extends from said central portion so as to facilitate repositioning of one of said puzzle pieces relative to another of said puzzle pieces; and a puzzle piece holder for holding said puzzle pieces, said puzzle piece holder comprising:

a first holder member in which said puzzle pieces may be at least partially disposed; and a second holder member associated with said first holder member, said first and second holder members being configurable in a storage position in which said puzzle pieces are retained within said first and second holder members regardless of the orientation of said puzzle piece holder, wherein each of said puzzle pieces has a second edge disposed between said first and second surfaces, each of said second edges of said puzzle pieces having a height no greater than about one-third of an inch, each of said second edges of said puzzle pieces having a different portion of a second image disposed thereon so that when said second edges of said puzzle pieces are arranged in a predetermined order said second image is formed thereon.

18. A puzzle toy as defined in claim 17 wherein said first holder member of said puzzle piece holder has a first opening formed therein and wherein said second holder member of said puzzle piece holder has a second opening formed therein, and wherein each of said images disposed on said edges of said puzzle pieces is visible through one of said openings in said first and second holder members of said puzzle piece holder.

19. A puzzle toy as defined in claim 14 wherein one of said holder members of said puzzle piece holder has a plurality of side walls and wherein one of said side walls has a top portion over which said tabs of said puzzle pieces are disposed when said puzzle pieces are disposed between said side walls.

20. A puzzle toy comprising:

a plurality of puzzle pieces, each of said puzzle pieces having a length, a width, and a thickness, each of said puzzle pieces having a first surface and a second surface and an edge disposed between said first and second surfaces, each of said edges of said puzzle pieces having a different portion of an image disposed thereon so that when said edges of said puzzle pieces are arranged in a predetermined order said image is formed thereon, each of said puzzle pieces having a central portion and a tab which extends from said central portion so as to facilitate repositioning of one of said puzzle pieces relative to another of said puzzle pieces; and a puzzle piece holder for holding said puzzle pieces, said puzzle piece holder comprising:

a first holder member in which said puzzle pieces may be at least partially disposed; and a second holder member associated with said first holder member, said first and second holder members being configurable in a storage position in which said puzzle pieces are retained within said first and second holder members regardless of the orientation of said puzzle piece holder, wherein one of said holder members has a plurality of slots formed therein and wherein the other of said holder members has a plurality of projecting members spaced so that said projecting members can be disposed within said slots when said first and second holder members are disposed in said storage configuration to fasten said first and second holder members together.

* * * * *